United States Patent [19]

Wolde-Tinsae

[11] 4,397,128

[45] Aug. 9, 1983

[54] REINFORCED MASONRY WALL STRUCTURE

[75] Inventor: Amde M. Wolde-Tinsae, Ames, Iowa

[73] Assignee: Iowa State University Research Foundation, Inc., Ames, Iowa

[21] Appl. No.: 234,690

[22] Filed: Feb. 17, 1981

[51] Int. Cl.[3] ..... E04B 1/16; E04B 5/08; E04F 13/04

[52] U.S. Cl. ..... 52/293; 52/381; 52/410; 52/443; 52/747

[58] Field of Search ..... 52/293, 415, 422, 436, 52/443, 444, 454, 410, 383, 353, 698, 747, 381

[56] References Cited

U.S. PATENT DOCUMENTS

| | | | |
|---|---|---|---|
| 1,084,967 | 1/1914 | Rosenleaf | 52/381 |
| 1,503,931 | 8/1924 | Wightman . | |
| 1,704,255 | 3/1929 | Lewis . | |
| 2,044,051 | 6/1936 | Briscoe . | |
| 2,366,156 | 1/1945 | Simonson . | |
| 2,889,698 | 6/1959 | Stevens | 52/410 |
| 3,025,641 | 3/1962 | Ahtianinen . | |
| 3,461,639 | 8/1969 | Merrill . | |
| 3,782,566 | 1/1974 | Nielson . | |
| 4,214,408 | 7/1980 | Rich, Jr. | 52/443 |

*Primary Examiner*—John E. Murtagh
*Assistant Examiner*—Richard E. Chilcot, Jr.
*Attorney, Agent, or Firm*—Zarley, McKee, Thomte, Vorhees & Sease

[57] ABSTRACT

A reinforced masonry wall structure comprising a horizontally disposed footing having a first layer of mortar on the upper surface thereof with a first plurality of courses of masonry blocks placed one upon the other with the lowermost course being positioned on the first layer of concrete. The masonry blocks in the first plurality of courses are in intimate contact with each other since mortar is not placed therebetween. A second layer of mortar is placed on the upper portion of the uppermost course of the first plurality of courses and a second plurality of courses of masonry blocks are placed one upon the other with the lowermost course being positioned on the second layer of mortar. The masonry blocks in the second plurality of courses are also in intimate contact with each other inasmuch as mortar is not positioned therebetween. First and second layers of plaster-like material are applied to opposite sides of the masonry blocks. Third and fourth layers of plaster-like material are positioned on the first and second layers respectively. A welded wire fabric material is positioned between each of the first and third and second and fourth layers of plaster-like material. Horizontally disposed reinforcing rods may be extended through the structure to achieve additional bond strength as desired.

10 Claims, 4 Drawing Figures

REINFORCED MASONRY WALL STRUCTURE

BACKGROUND OF THE INVENTION

Masonry block walls are normally formed by laying courses of blocks one upon the other with mortar being positioned between the horizontal and vertical joints thereof. If the wall is to be reinforced, vertically disposed reinforcing rods are normally threaded downwardly through the voids in the block members. The conventional method of constructing masonry block walls is time-consuming and expensive.

Additionally, the technical knowledge and understanding of masonry has not been as extensive as for other building materials although masonry is one of the oldest building materials. The lag in technical knowledge became particularly evident with the development and increased interest in seismic resistant structures. In areas of probable earthquake activity or high winds, concrete masonry walls must be of the reinforced type. In multi-width construction, reinforcements are placed between the widths and grouting performed either periodically as the wall is erected or entirely after the wall has been erected. In single-width construction consisting of regular hollow concrete masonry units, the provision of internal vertical reinforcements pose some difficulty as the masonry units must be threaded downwardly over the rods unless open-end units are used. In some single-width construction, the hollow masonry blocks may be aligned to allow subsequent placement of vertical reinforcements and the performance of high-lift grouting. This, however, cannot be done with ease when the wall must be constructed within an existing frame system, and the use of special-shaped units becomes a necessity.

Therefore, it is a principal object of the invention to provide a novel reinforced masonry wall structure.

A further object of the invention is to provide a reinforced masonry wall structure which eliminates the need for mortar between the courses of blocks.

A still further object of the invention is to provide a reinforced masonry wall structure which is seismic resistant.

A still further object of the invention is to provide a reinforced masonry wall structure which eliminates the need for threading vertical reinforcement rods downwardly through the block members.

A still further object of the invention is to provide a reinforced masonry wall which eliminates the time-consuming and expensive practices of internal reinforcements and laying the masonry blocks in mortar, course by course.

A still further object of the invention is to provide a reinforced masonry wall having improved wind resistance.

These and other objects will be apparent to those skilled in the art.

SUMMARY OF THE INVENTION

Figure 1:
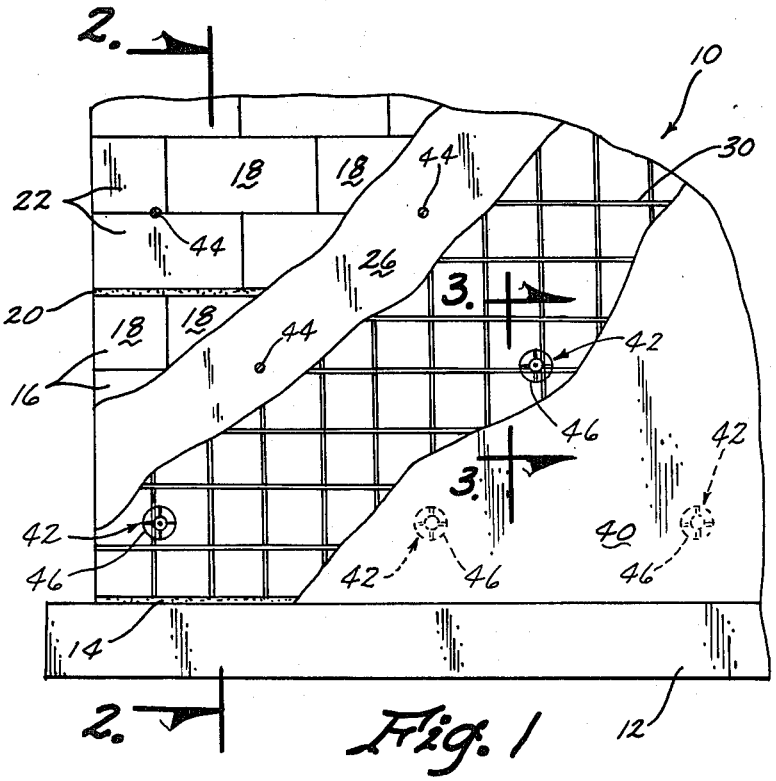
FIG. 1 is a side view of the wall structure of this invention with portions thereof cut away to more fully illustrate the invention.
Figure 2:
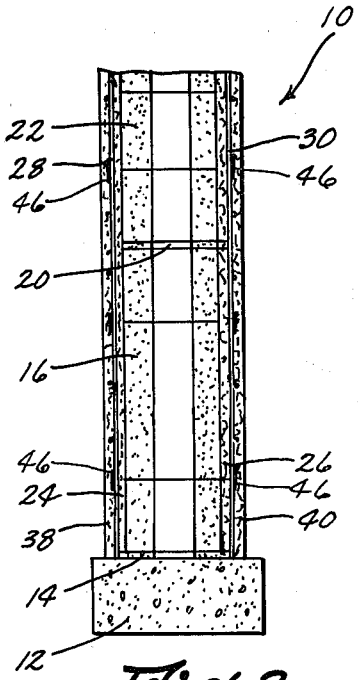
FIG. 2 is a sectional view of the wall structure as seen on lines 2—2 of FIG. 1.

The reinforced masonry wall structure of this invention is formed by positioning a first layer of mortar upon a horizontally disposed footing and then placing a plurality of courses of blocks one upon the other on the layer of mortar. The blocks are placed in intimate contact with each other due to the fact that mortar is not positioned between the individual blocks. A second layer of mortar is placed on the top portion of the courses of blocks and a second plurality of courses of blocks are then placed one upon the other on the second layer of mortar. First and second layers of plaster are applied to opposite sides of the wall structure. Welded wire fabric material is then placed on the exterior surfaces of the first and second layers of plaster. Third and fourth layers of plaster are then applied to the exterior surfaces of the first and second layers and the wire fabric. If additional bond strength is required, horizontally disposed reinforcing rods may be extended through the first and second layers of plaster and the blocks. The outer ends of the reinforcing rods are provided with flat plates or the like which are positioned outwardly of the wire fabric.

DESCRIPTION OF THE PREFERRED EMBODIMENT

The wall structure of this invention is referred to generally by the reference numeral 10 and is positioned upon a conventional horizontally disposed footing 12. The wall structure 10 is formed by first placing a layer of mortar 14 upon the upper surface of the footing 12 in conventional fashion. A first plurality of courses of blocks 16 comprised of individual masonry block members 18 are placed one upon the other in a dry fashion so as to be in intimate contact with each other. It is important to note that mortar is not placed between the horizontal and vertical joints of the block members.

A second layer of mortar is placed upon the top portion of the uppermost course 16 and a second plurality of courses of blocks 22 comprised of individual masonry block members 18 are then placed one upon the other in a dry fashion. The block members in the courses 22 are also in intimate contact with each other since mortar is not placed in the vertical or horizontal joints.

Figure 3:
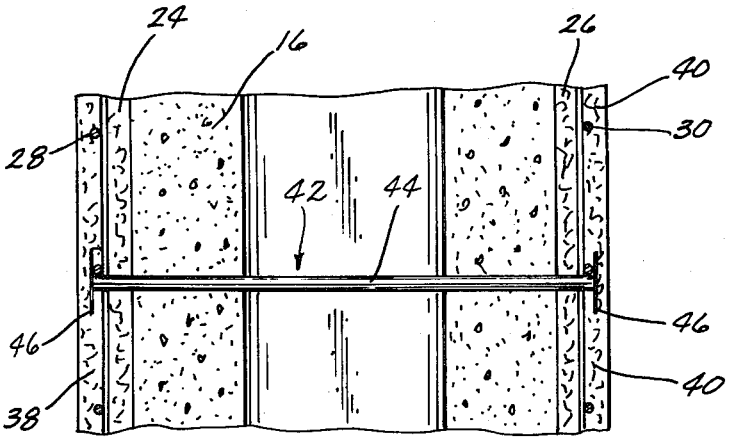
FIG. 3 is an enlarged sectional view seen on lines 3—3 of FIG. 1.
Figure 4:
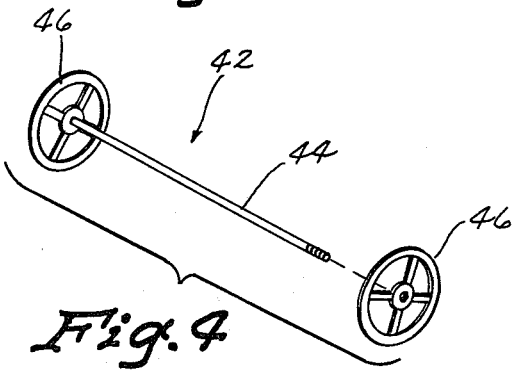
FIG. 4 is an exploded perspective view of one form of the anchorage device.

Layers 24 and 26 of plaster or the like are then applied ot the opposite sides of the block members 18 by spraying or the like. It is recommended that the layers 24 and 26 be approximately ½ inch thick. Welded wire fabric 28 and 30 is then mounted on the exterior surface of the layers 26 and 28. Additional bond strength may be provided by one of several means. One possible anchorage device is shown in FIG. 4 and referred to by the reference numeral 42. Device 42 consists of a rod 44 attached to a wheel-like flat plate 46 and threaded at its other end. The device may be driven between the blocks after the welded wire fabrics have been put in place and the wheel-like flat plates 46 screwed onto the threaded ends. If it is desired to put the devices in while the blocks are being piled, pins with two threaded ends may be used and subsequently after the welded wire fabrics are in place, the plates 46 or the like may be screwed to the two ends of each rod 44. When in position, the plates 46 are positioned outwardly of the wire fabric and engage the same as illustrated in the drawings. After allowing time for the layers 24 and 26 to cure, layers 38 and 40 of plaster or the like are then applied to opposite sides of the wall as best seen in FIG. 3.

The resulting wall structure is very resistant to seismic activity and will resist wind loads applied thereto. The wall structure eliminates the time-consuming and expensive practices of internal reinforcement and the positioning of mortar between the individual blocks. The resulting wall structure therefore accomplishes at least all of its stated objectives.

I claim:

1. A reinforced masonry wall structure, comprising, a horizontally disposed footing, a first layer of mortar on the upper surface of said footing, a first plurality of courses of masonry blocks placed one upon the other with the lowermost course being positioned on the said first layer of mortar, said masonry blocks in said first plurality of courses being in intimate contact with each other, a second layer of mortar on the upper portion of the uppermost course of said first plurality of courses, a second plurality of courses of masonry blocks placed one upon the other in the vertical plane of the first plurality of courses with the lowermost course of said second plurality of courses being positioned on the said second layer of mortar, said masonry blocks in said second plurality of courses being in intimate contact with each other, a first layer of plaster-like material on one side of said masonry blocks, a second layer of plaster-like material on the other side of said masonry blocks, a third layer of plaster-like material positioned on said first layer, a fourth layer of plaster-like material positioned on said second layer, a wire fabric material between said first and third layers of plaster-like material, and a wire fabric material between said second and fourth layers of plaster-like material.

2. The wall structure of claim 1 wherein a plurality of horizontally disposed reinforcing rods extend through said first and second layers of plaster-like material and between courses of the masonry block members in a spaced relationship.

3. The wall structure of claim 2 wherein flat plates are secured to the opposite ends of said rods.

4. The wall structure of claim 3 wherein said flat plates dwell in a plane parallel to the exterior surfaces of the wall structure and are secured to the said wire fabric material.

5. The wall structure of claim 2 wherein substantially flat plates are threadably secured to the opposite ends of the rod.

6. The wall structure of claim 3 wherein at least one of the flat plates is threadably secured to the said rod.

7. A method of constructing a reinforced masonry wall structure upon a horizontally disposed footing, comprising, positioning a first layer of mortar on the upper surface of said footing, placing a first plurality of courses of masonry blocks one upon the other including positioning the lowermost course on the said first layer of mortar and placing said masonry blocks in said first plurality of courses in intimate contact with each other, placing a second layer of mortar on the upper portion of the uppermost course of said first plurality of courses, placing a second plurality of courses of masonry blocks one upon the other including positioning the lowermost course thereof on the said second layer of mortar and placing said masonry blocks in said second plurality of courses in intimate contact with each other, applying a first layer of plaster-like material on one side of said masonry blocks free of any exterior forms, applying a second layer of plaster-like material on the other side of said masonry blocks free of any exterior forms, placing a wire fabric material on the exterior surface of said first layer of plaster-like material, placing a wire fabric material on the exterior surface of said second layer of plaster-like material, applying a third layer of plaster-like material on said first layer and on the wire fabric material thereon free of any exterior forms, and applying a fourth layer of plaster-like material on said second layer and on the fabric material thereon free of any exterior forms.

8. The method of claim 7 wherein the steps of applying said layers of plaster-like material comprises spraying said plaster-like material.

9. The method of claim 7 further comprising horizontally extending reinforcing rods through the first and second layers of plaster-like material and the blocks.

10. The method of claim 9 further comprising positioning flat plates on the outer ends of the reinforcing rods outwardly of said wire fabric material.

* * * * *